United States Patent [19]

Shirasuna et al.

[11] 4,166,586

[45] Sep. 4, 1979

[54] YARN WINDING METHOD AND APPARATUS

[75] Inventors: Katuo Shirasuna; Ichiro Kumo; Teruo Kobayashi; Shigeo Ohno, all of Mishima, Japan

[73] Assignee: Toray Industries, Inc., Tokyo, Japan

[21] Appl. No.: 907,337

[22] Filed: May 18, 1978

[51] Int. Cl.[2] ..... B65H 54/02; B65H 67/00

[52] U.S. Cl. ..... 242/18 PW; 57/299; 57/303; 242/18 DD; 242/19; 242/35.5 A

[58] Field of Search ..... 242/18 PW, 18 R, 18 DD, 242/35.5 A, 19, 18 A; 57/34 CP, 34 TT, 34 PW, 34 R, 34 HS, 299, 303

[56] References Cited

U.S. PATENT DOCUMENTS

| | | | |
|---|---|---|---|
| 2,481,031 | 9/1949 | McDermott | 242/18 PW |
| 2,706,089 | 4/1955 | Griset, Jr. | 242/18 R |
| 3,034,736 | 5/1962 | Rhein, Jr. | 242/18 R |
| 3,307,800 | 3/1967 | Macedo | 242/18 R X |
| 3,475,891 | 11/1969 | Matsuoka et al | 57/34 CP |
| 3,666,431 | 5/1972 | Oswald | 242/18 R X |
| 3,857,523 | 12/1974 | Lenderman | 242/18 PW X |
| 3,948,452 | 4/1976 | Burysek et al. | 242/18 PW X |
| 4,062,501 | 12/1977 | Eisenberg et al. | 242/18 PW X |

FOREIGN PATENT DOCUMENTS

| | | | |
|---|---|---|---|
| 50-24553 | 3/1975 | Japan | 242/18 PW |

*Primary Examiner*—Stanley N. Gilreath
*Attorney, Agent, or Firm*—Armstrong, Nikaido, Marmelstein & Kubovcik

[57] ABSTRACT

A yarn winding method is disclosed where at the step of winding yarn on bobbin, at changing a full bobbin to an empty bobbin, a running yarn is wound on an auxiliary winding roller provided separately from the bobbin, travelling of the yarn and rotation of the auxiliary winding roller are then stopped, a full bobbin is exchanged by an empty bobbin, a part of the yarn wound on the auxiliary winding roller is then taken out to form a thread line for setting the yarn to the empty bobbin, travelling of the yarn, rotation of the auxiliary roller and rotation of the empty bobbin are then started, the yarn-setting thread line is shifted toward the side of the empty bobbin to wind the running yarn onto the empty bobbin, and the normal winding operation on the empty bobbin is then started. Also an apparatus for practicing this yarn winding method is disclosed.

2 Claims, 22 Drawing Figures

YARN WINDING METHOD AND APPARATUS

BACKGROUND OF THE INVENTION

This invention relates to a yarn winding method and apparatus.

In the process for the manufacture of yarn of synthetic fibers, while undrawn yarn, semi-drawn yarn or drawn yarn is travelling from yarn supply sources such as package, the yarn passes through a series of steps, for example, the step of treating yarn, such as the false-twisting step, and the step of winding the treated yarn.

At the yarn winding step, in general, there are disposed many winders to wind up an number of yarns. Bobbins are provided to each of these winders, and when predetermined amounts of yarns are wound on these bobbins, namely when the bobbins become full, the bobbins are taken out from the winder and empty bobbins on which subsequent yarns are to be wound are set to the winder. Then, the winding operation is started again to wind yarns on these empty bobbins. In short, the bobbin exchange operation is inevitably conducted at the winding step. This bobbin exchange operation will now be described by reference to the accompanying drawing.

FIG. 1 is a diagram illustrating an instance of the process including the yarn treating step and the yarn winding step. Referring to FIG. 1, the process includes the yarn treating step A where a yarn 2 taken out from a package 1 is passed through a first feed foller 3, a false twister 4, a second feed roller 5 rotated at a speed higher than the rotation speed of the first feed roller 3, an interlacing element 6 disposed according to need and a third feed roller 7 in succession, and the yarn winding step B where the yarn 2 fed from the step A is passed through a winder 12 including at least a traverse fulcrum guide 8, traversing means 9 and a rotary element 11 for rotating a bobbin 10. A guide roller 13, a suction gun 14 or other device is disposed between the two steps A and B. Incidentally, the yarn from the false twister 4 of the treating step A is heated by a hot plate 15 and is then heat-set by a hot plate 16. When a predetermined amount of the yarn is wound on the bobbin 10 in the winder 12 and the bobbin 10 becomes full, the rotary element 11 of the winder 12 is stopped and the full bobbin is taken out from the winder 12, and an empty bobbin is set thereto instead and the yarn winding operation is started again on this empty bobbin. This operation of taking out a full bobbin from the winder and setting an empty bobbin thereto is ordinarily called "the bobbin exchange operation" in the art.

Even during the bobbin exchange operation, supply of the yarn to the winding step B is continued unless travelling of the yarn 2 running through the treating step A is stopped. There is ordinarily adopted a method in which travelling of the yarn 2 passing through the treating step A is continued even during the bobbin exchange operation, the yarn 2 running from the step A to the step B is continuously sucked by the suction gun 14 during the bobbin exchange operation and the yarn sucked during the bobbin exchange operation is disposed of as waste. After completion of the bobbin exchange, namely after setting an empty bobbin 10 to the winder 12 and completing the preparation for winding the yarn on the empty bobbin 10, the yarn sucked on the suction gun 14 is introduced to and wound on the empty bobbin 10 being rotated. Thus, one cycle of the bobbin exchange operation is completed.

According to this conventional method, it is possible to perform the bobbin exchange operation in the respective winders of one winding machine independently without stopping entirely this winding machine including a plurality of winding units, each having one winder as mentioned above (accordingly, the yarn treating step A includes a plurality of yarn treating units). Therefore, this method is advantageous in that a very high operation efficiency can be attained. However, the time required for completion of the bobbin exchange operation in one winding unit is about 20 seconds, and the amount of the yarn to be sucked by the suction gun during this period and disposed of as waste is considerable. With recent increase of the treating capacity at the treating step, also the amount of waste formed during the bobbin exchange operation is increased and it is sometime as large as 1% of the product yarn. From the viewpoint that resources on the earth should be saved, generation of a large quantity of such waste is not preferred.

Under such background, we have conducted research with a view to developing a method in which the amount of waste produced during the bobbin exchange operation in a winding machine including a number of winding units can be remarkably reduced, and found that production of waste can be markedly reduced by adoption of a specific winding method. It also was found that this winding method can be practised very effectively by adoption of a specific winding apparatus created as means for practising this winding method.

OBJECTS OF THE INVENTION

It is a primary object of the present invention to provide a yarn winding method in which production of waste during the bobbin exchange operation can be remarkably controlled and an apparatus for practising this method effectively.

Another object of the present invention is to provide a method comprising simultaneously winding a number of yarns in a number of yarn winding units, in which during the bobbin exchange operation in each winding unit, travelling of a yarn running from a yarn supply source such as a package to the winding unit is stopped and the bobbin exchange operation is completed while travelling of the yarn is stopped, whereby generation of waste by the bobbin exchange operation can be reduced to a level as low as possible, and an apparatus for practising this winding method effectively.

When such winding method is adopted, travelling of the yarn running through the treating step from the yarn supply source and being introduced into the winding step is stopped during the bobbin exchange operation, and therefore, setting of the yarn to an empty bobbin should be accomplished according to a technique quite different from the conventional technique. One of characteristic features of the present invention resides in development of such new technique of setting the yarn to an empty bobbin.

Other objects and features of the present invention will be apparent from the following description.

BRIEF SUMMARY OF THE INVENTION

In accordance with one fundamental aspect of the present invention, the foregoing objects can be attained by a yarn winding method comprising the steps of (a) shifting a thread line of a yarn running to a full bobbin to the outside of a yarn-traversing width and introducing the yarn to a rotating auxiliary winding roller disposed separately from bobbins to wind the yarn on said auxiliary winding roller, (b) stopping travelling of the yarn and rotation of the auxiliary winding roller, (c) taking out the full bobbin from a winder and attaching an empty bobbin to the winder (d) rotating the auxiliary winding roller in the reverse direction to unwind the yarn therefrom and thus forming a yarn-setting thread line to the empty bobbin, (e) starting travelling of the yarn, rotation of the auxiliary winding roller in the normal direction and rotation of the empty bobbin, and (f) shifting the yarn-setting thread line within the yarn-traversing width to start winding of the running yarn.

One of the characteristic features of the present invention resides in that an auxiliary winding roller is used, a yarn wound on this roller is once taken out therefrom and used for forming a thread line for setting the yarn to an empty bobbin, and after formation of this yarn-setting thread line, travelling of the yarn is started and the running yarn is wound on the auxiliary winding roller again while the yarn is wound on the empty bobbin. As is seen from the foregoing illustration, this auxiliary winding roller is different from yarn winding means so-called "waste spool", which is disposed in the conventional yarn winding apparatus separately and independently from bobbins, with respect to the object and function. More specifically, a yarn wound on the conventional waste spool is not taken out for formation of a thread line but it is only disposed of as waste.

The above-mentioned yarn winding method of the present invention is preferably practised by using the following yarn winding apparatus.

More specifically, in accordance with another aspect of the present invention, there is provided a yarn winding apparatus which comprises (a) a supporting arm on which a bobbin is dismountably and rotatably supported, (b) a rotating and driving element for rotating the bobbin, (c) a traversing element for traversing a running yarn fed to the bobbin, (d) a traverse fulcrum guide for forming a traverse fulcrum for the traversed yarn, (e) a moving element for shifting the traverse fulcrum guide within the yarn-traversing width from the outside thereof, (f) an auxiliary winding roller located at a position where the auxiliary winding roller can catch the yarn conveyed by the traverse fulcrum guide when the traverse fulcrum guide is shifted to the outside of the yarn-traversing width, (g) a rotating and driving element for rotating the auxiliary winding roller in the yarn-winding normal direction and an element for rotating the auxiliary winding roller in the reverse direction, (h) a detour guide for forming a thread line for setting to the bobbin the yarn extended from the auxiliary winding roller to the traverse fulcrum guide located outside the yarn-traversing width, by taking out the yarn from the auxiliary winding roller, and (i) a yarn-setting thread line-forming guide for preventing the yarn on said yarn-setting thread line from falling in contact with the auxiliary winding roller at a point different from the yarn take-up point when the yarn on said yarn-setting thread line is shifted toward the bobbin.

DETAILED DESCRIPTION OF THE PREFERRED EMBODIMENTS

The structure of the apparatus of the present invention will first be described and the operation of the apparatus will be then illustrated. The method of the present invention will be apparent from the illustration of the operation of the apparatus.

Figure 1:
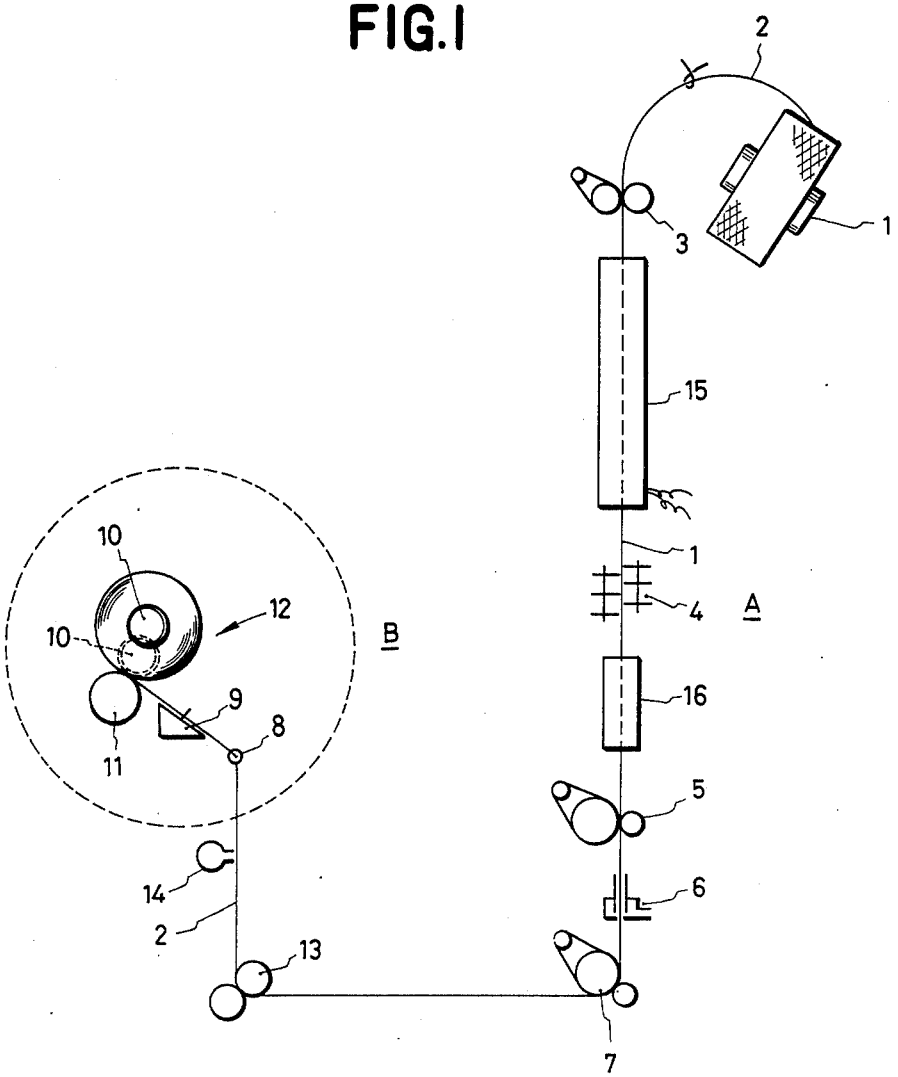
FIG. 1 is a view showing diagrammatically the yarn-treating step and yarn-winding step to which the present invention is applied.
Figure 2:
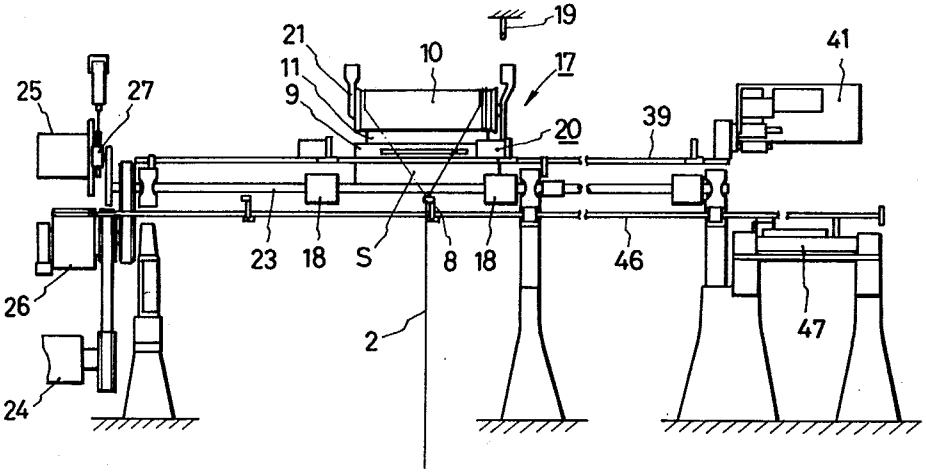
FIG. 2 is a front view showing the main part of the yarn winding apparatus of the present invention.
Figure 3:
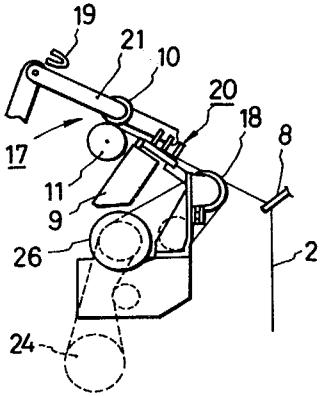
FIG. 3 is a side view showing the main part of the yarn winding apparatus shown in FIG. 2.

The present invention relates to an apparatus covering the circular zone surrounded by a dotted line in FIG. 1. The front and side of the main part of the apparatus of the present invention are illustrated in FIGS. 2 and 3, respectively. In these FIGS. 2 and 3, only one unit of the apparatus of the present invention is shown, and other units are omitted.

The apparatus of the present invention comprises as indispensable elements at least yarn winding means 17, a traverse fulcrum guide 8, traversing means 9, an auxiliary winding roller 18, a detour guide 19 and a yarn-setting thread line-forming guide 20. These six indispensable elements will now be described in detail.

The yarn winding means 17 includes a bobbin 10 on which a yarn is to be wound, a bobbin supporting arm 21 for supporting the bobbin 10 dismountably and rotatably thereon and a rotating and driving element 11 for rotating the bobbin 10 according to the surface drive system (the drive source is not illustrated in the drawing). This yarn winding means 17 has a function of substantially winding the yarn on the bobbin.

The traverse fulcrum guide 8 has the same function as in the conventional apparatus. More specifically, the traverse fulcrum guide 8 is disposed upstream of traversing means 9 to act as a fulcrum for traversing the yarn by the traversing means 9 adapted to traverse the yarn to the winding means 17 and wind up the yarn. In the apparatus of the present invention, this traverse fulcrum guide 8 is arranged so that before and after the bobbin exchange operation described hereinafter, the traverse fulcrum guide 8 is moved from the front portion of the bobbin to the front position of the auxiliary winding roller 18 described below in a direction parallel to the axial direction of the bobbin and is then returned to the original position. Further, the traverse fulcrum guide 8 is arranged so that it can stop at the above-mentioned two front positions. For practicing these motions, the traverse fulcrum guide 8 is connected with a moving back and forth rod 46. The rod 46 is moved by operating moving rod means 47.

The traversing means 9 is adapted to give a reciprocative movement in a direction parallel to the axial direction of the bobbin to the yarn 2 which has passed through the traverse fulcrum guide 8 and is going to be wound on the bobbin 10, and this traversing means 9 is located between the bobbin 10 and the traverse fulcrum guide 8.

The foregoing elements and the combination thereof are well known and customarily adopted in the conventional winding apparatuses, except the feature that the traverse fulcrum guide 8 has a movable structure. For example, the foregoing elements and the combination thereof constitute winding means as illustrated in the specification of British Pat. No. 1,174,441.

One of characteristic features of the present invention resides in that these known elements are combined with specific elements, namely an auxiliary winding roller 18, a detour guide 19 and a yarn-setting thread line-forming guide 20, and these elements are disposed so that a specific mutual positional relationship is established among them.

These specific elements and the specific layout of these elements will now be described in detail by reference to FIGS. 2 and 4 to 8.

Figure 5:
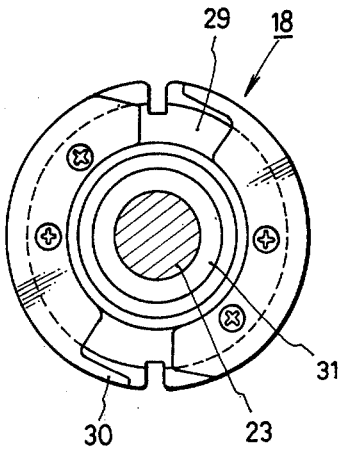
FIG. 5 is a side view showing the auxiliary winding roller illustrated in FIG. 4.
Figure 4:
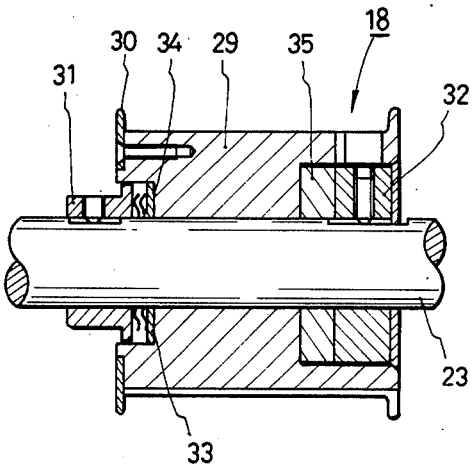
FIG. 4 is a sectional view showing the auxiliary winding roller.
Figure 6:
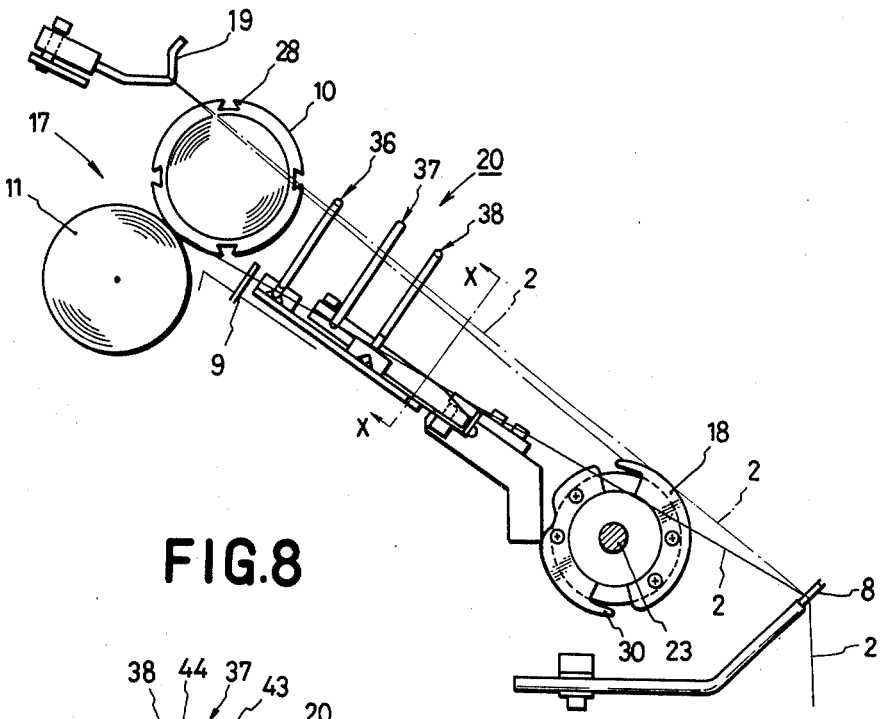
FIG. 6 is a side view illustrating the layout of the traverse fulcrum guide, auxiliary winding roller, traversing means, yarn winding means, yarn-setting thread line-forming guide and detour guide in the present invention.
Figure 8:
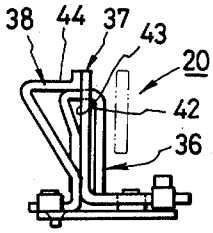
FIG. 8 is a front view of the yarn-setting thread line-forming guide illustrated in FIG. 6.
Figure 7:
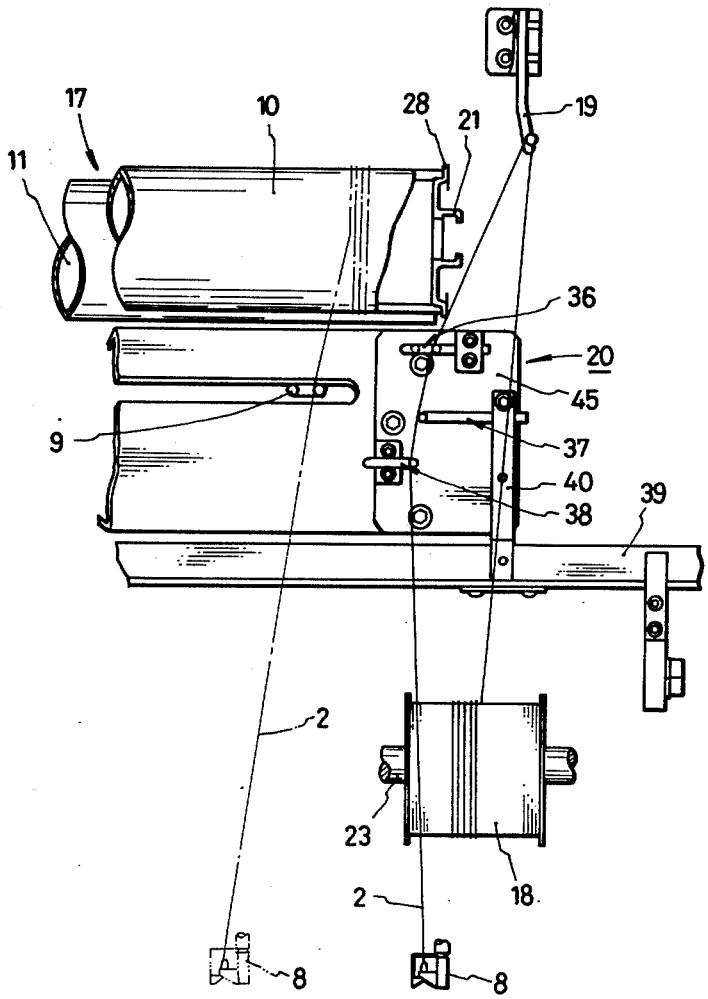
FIG. 7 is a plan view showing the layout illustrated in FIG. 6.

Incidentally, FIG. 4 is a sectional view of the auxiliary winding roller and FIG. 5 is a side view of the auxiliary winding roller. FIG. 6 is a side view illustrating the layout of the traverse fulcrum guide, auxiliary widing roller, yarn-setting thread line-forming guide, traversing means, yarn winding means and detour guide, and FIG. 7 is a plan view showing the layout illustrated in FIG. 6. FIG. 8 is a front view showing the yarn-setting thread line-forming guide shown in FIG. 6.

As shown in FIGS. 6 and 7, the auxiliary winding roller 18 is disposed between the traverse fulcrum guide 8 and the traversing means 9 and is attached to rotation shaft 23. As is seen from FIG. 2, the auxiliary winding roller 18 is located on the outside of the width of the traverse produced by the movement of the traversing means 9.

The auxiliary winding roller 18 can be rotated in both the normal direction (yarn-winding direction) and the reverse direction (yarn-unwinding direction). Auxiliary winding rollers 18 of a plurality of units, each including the winding apparatus of the present invention, may be connected to a common rotation shaft 23 and may be rotated by this common rotation shaft 23 (FIG. 2). This common rotation shaft 23 is operated by a normal rotation drive device 24 and a reverse rotation drive device 25, and these two mechanisms 24 and 25 can be independently operated by a normal rotation clutch 26 and a reverse rotation clutch 27, respectively (FIG. 2). For example, for rotating the rotation shaft 23 in the normal direction, the operation of the reverse rotation clutch 27 is stopped and the rotation of the normal rotation drive device 24 is transmitted to the rotation shaft 23 through the normal rotation clutch 26. On the other hand, when the rotation shaft 23 is rotated in the reverse direction, the operation of the normal rotation clutch 23 is stopped and the rotation of the reverse rotation drive device 25 is transmitted to the rotation shaft 23 through the reverse rotation clutch 27.

The auxiliary winding roller 18 that is used in the present invention is characterized in that it comprises (1) a yarn cutting and holding mechanism for cutting the yarn when the auxiliary winding roller 18 is being rotated and the running yarn falls in contact with a yarn cutting and holding hook 30 (hereinafter referred to as "cutting hook") attached to the terminal portion of the auxiliary winding roller 18 and for holding the thus formed cut end of the yarn running from the yarn supply source on said cutting hook 30 and starting winding of the yarn on the auxiliary winding roller in this state, and (2) a slip mechanism for producing a slip between the auxiliary winding roller 18 and the rotation shaft 23 when a load exceeding a certain level is imposed on the auxiliary winding roller 18.

As such mechanisms, there can be mentioned those illustrated in FIGS. 4 and 5. Namely, the yarn cutting and holding mechanism is constructed by attaching a cutting hook 30 to the edge of a body 29 of the auxiliary winding roller 18, and the slip mechanism is constructed by mounting stop collars 31 and 32 on both the end sides of the roller body 29, fixing the collars 31 and 32 to the rotation shaft 23 and interposing a wavy washer 33 and a plate 34 between the collar 31 and the roller body 29 and a friction plate 35 between the other collar 32 and the roller body 29. In the normal operation state, the roller body 29 can be rotated with rotation of the rotation shaft 23, but when a load exceeding a certain level is imposed on the roller body 29, a slip is produced between the roller body 29 and the rotation shaft 23. By provision of this slip mechanism, there can be attained an effect that when the roller diameter of the auxiliary winding roller 18 is substantially increased by winding of a large quantity of the yarn thereon and the running yarn is further wound up on this auxiliary winding roller 18, cutting of the yarn by increase of the tension imposed on the yarn can be effectively prevented. Further, when the yarn wound on the auxiliary winding roller is taken out for formation of a yarn-setting thread line, this slip mechanism is useful for rotating the auxiliary winding roller in the reverse direction manually.

Figure 13:
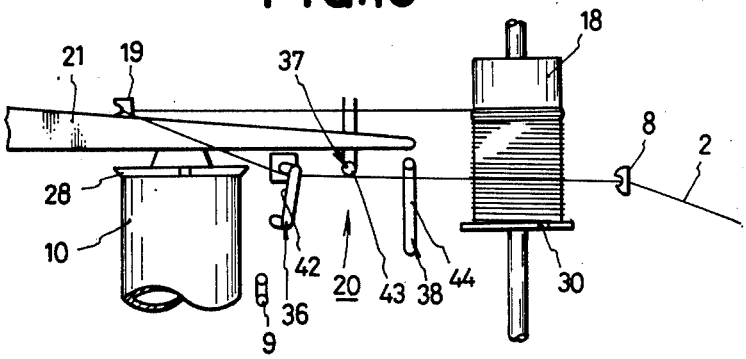
Figure 14:
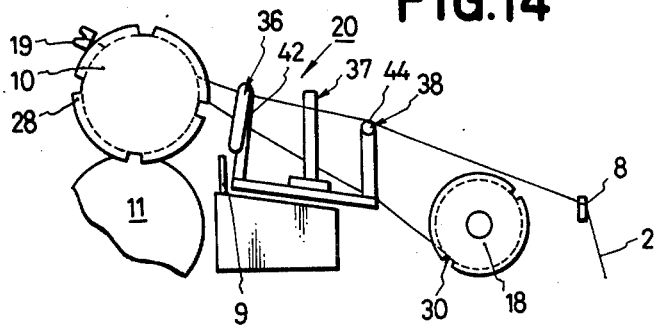

The detour guide 19 is a hook-like guide disposed on that side of the bobbin 10 where the auxiliary winding roller 18 is not present, and this guide 19 is fixed to a fixed member of the winding apparatus or the bobbin-supporting arm (FIGS. 13 and 14).

Another important element of the apparatus of the present invention is a yarn-setting thread line-forming guide 20, which has the following structure and function.

The yarn-setting thread line-forming guide 20 is adapted to exert such a function that when the thread line of the yarn between the traverse fulcrum guide 8 and the detour guide 19 is shifted within the traverse width by the movement of the traverse fulcrum guide 8, the yarn present on this thread line is prevented from falling in contact with the auxiliary winding roller 18 and the yarn can be set and touched onto the empty bobbin assuredly.

The structure of the yarn-setting thread line-forming guide 20 having the above function is illustrated in FIGS. 6, 7 and 8 (FIG. 8 is a view showing the section taken along the line X—X of FIG. 6). As is seen from these Figures, the yarn-setting thread line-forming guide 20 consists of three guide elements 36, 37 and 38 differing in the configuration (these elements are referred to as "first guide", "second guide" and "third guide", respectively). The first guide 36 and the third guide 38 are fixed to and erected on a base plate 45 but the second guide 37 is arranged so that by a back and forth moving bar 39 in the direction parallel to the axial direction of the bobbin, the guide 37 is fixed on an arm 40 of the bar 39, as shown in FIG. 7. The bar 39 has such a structure that it can be moved by operating bar moving means 41 shown in FIG. 2. Main front shapes of these guides 36, 37, and 38 are shown in FIG. 8, and respective parts of these guides have specific heights so that they can exert specific function described below. Further, when they are seen from above, a specific positional relationship as shown in FIG. 7 is established among them.

The shapes, heights and positions of these guides 36, 37 and 38 are specifically arranged so that the bobbin exchange operation can be performed in the manner as intended by the present invention. These factors of the guides 36, 37 and 38 will be described in detail after the method of the present invention has been illustrated.

The bobbin exchange operation according to the method of the present invention using the apparatus having the above-mentioned structure as one unit will now be described by reference to FIGS. 9 to 22.

Figure 9:
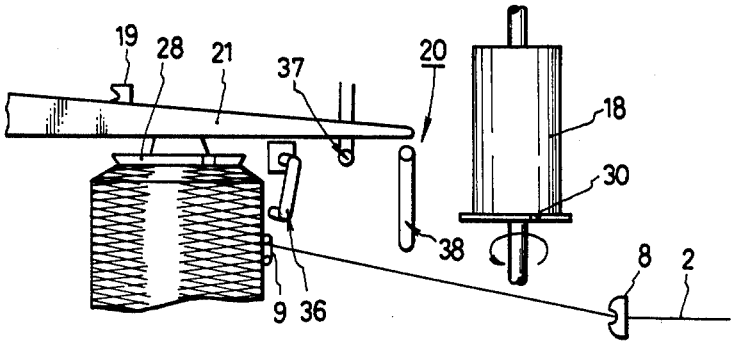
FIGS. 9 to 22 are plan views and side views of the main part of the yarn winding apparatus, which illustrate the operation procedures in the yarn winding method of the present invention.
Figure 10:
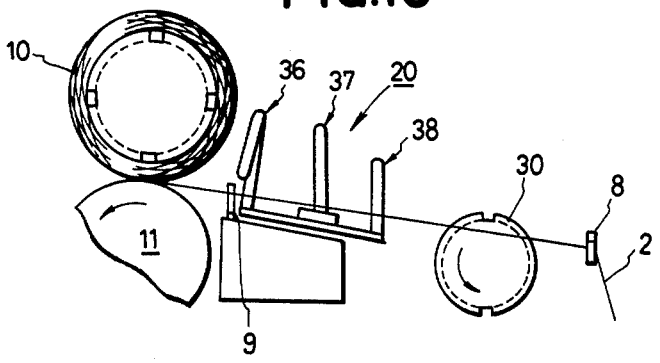
Figure 11:
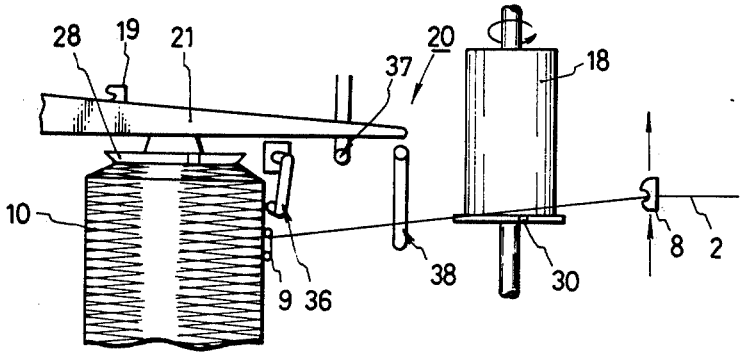

As in the conventional method illustrated in FIG. 1, the yarn 2 taken out from the package 1 is treated at the yarn-treating step A, and the yarn 2 is wound on a bobbin 10 at the winding step B. A predetermined amount of the yarn is wound on the bobbin 10, and the bobbin 10 becomes full (FIGS. 9 and 10). This full bobbin is exchanged by an empty bobbin according to the following procedures.

First Operation

At first, the auxiliary winding roller 18 is rotated (FIGS. 9 and 10). At this point, the rotation direction of the auxiliary winding roller 18 is the so-called normal rotation direction indicated by an arrow, namely the direction for winding the yarn on this auxiliary winding roller 18 according to procedures described below.

Second Operation

Figure 12:
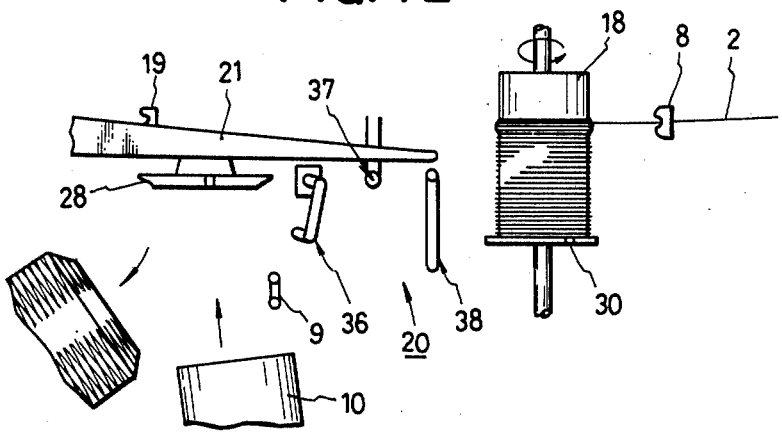

The traverse fulcrum guide 8 is shifted to the front of the auxiliary winding roller 18 as indicated by an arrow (FIG. 1). At this point, the yarn 2 running between the bobbin 10 and the traverse fulcrum guide 8 is caught on the cutting hook 30 of the auxiliary winding roller 18 (FIG. 11), and the yarn is cut. The cut end of the yarn on the side wound on the bobbin 10 is wrapped into the bobbin 10, but the cut end of the yarn on the side of the yarn supply source is held as it is on the auxiliary winding roller 18 and wound thereon. Namely, the yarn running from the yarn supply source passes through a thread line extending from the yarn supply source to the auxiliary winding roller 18 via the traverse fulcrum guide 8 (FIG. 12).

Third Operation

Travelling of the yarn running through the treating step A and the winding step B is stopped, and the full bobbin is taken out (FIG. 12) and an empty bobbin 10 is attached to the bobbin supporting arm 21 instead.

Fourth Operation

The yarn present between the auxiliary winding roller 18 and the traverse fulcrum guide 8 is taken out or slackened by rotating the auxiliary winding roller 18 in the reverse direction, and the yarn is hung on the detour guide 19, a marginal portion 42 of the first guide 36 (FIG. 8), a side portion 43 of the second guide (FIG. 8) and a head 44 of the third guide 38 (FIG. 8) and is tightened to the traverse fulcrum guide 8. The degree of the reverse direction rotation of the auxiliary winding roller 18 in the above operation is preferably set by the angle or rotation number necessary for hanging the yarn on the above guide members and elements (FIGS. 13 and 14).

Fifth Operation

The operations are simultaneously started at both the treating step A and the winding step B. At this point, the bobbin 10 is rotated, and the yarn 2 which has passed through the traverse fulcrum guide 8 begins to be wound on the auxiliary winding roller 18 (FIGS. 13 and 14).

Sixth Operation

Figure 15:
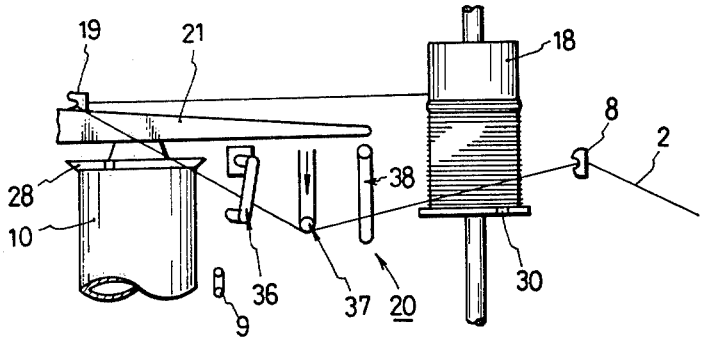
Figure 16:
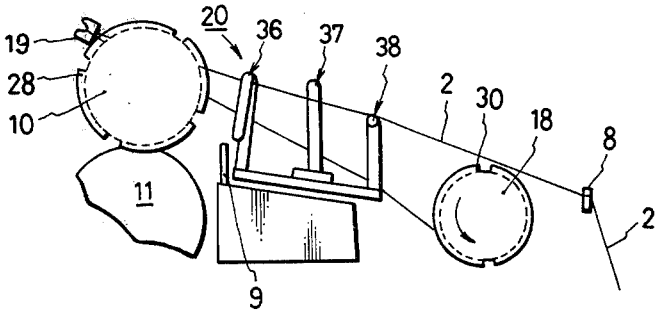

The second guide 37 of the yarn-setting thread line-forming guide 20 is brought close to the front of the bobbin 10 as indicated by an arrow (FIG. 15). At this point, the thread line formed among the detour guide 19 and the traverse fulcrum guide 37 is forcibly shifted toward the side of the bobbin 10 along the first guide 36 and the third guide 38 and finally, the yarn 2 is caused to fall in contact with the cutting hook 28 mounted on a bobbin holding chuck rotatably attached to the bobbin supporting arm 21 (FIGS. 15 and 16). Accordingly, said yarn 2 is cut, and the running yarn is turned while the end of the running yarn is held on the hook 28 and winding of the running yarn on the bobbin 10 is started (FIGS. 17 and 18).

Seventh Operation

Figure 17:
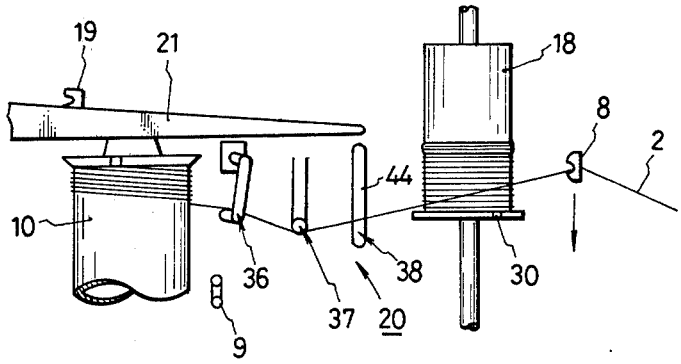
Figure 18:
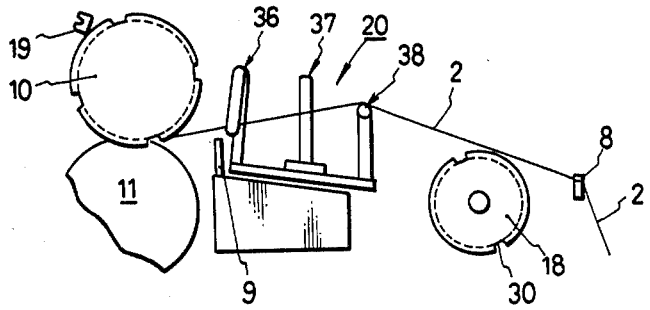
Figure 19:
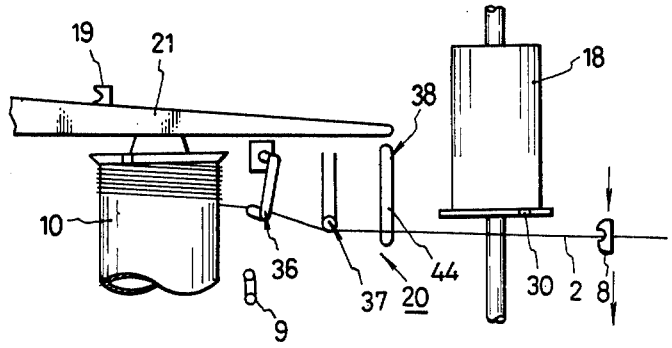
Figure 20:
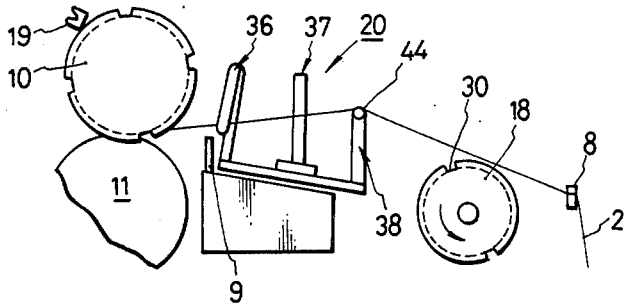
Figure 21:
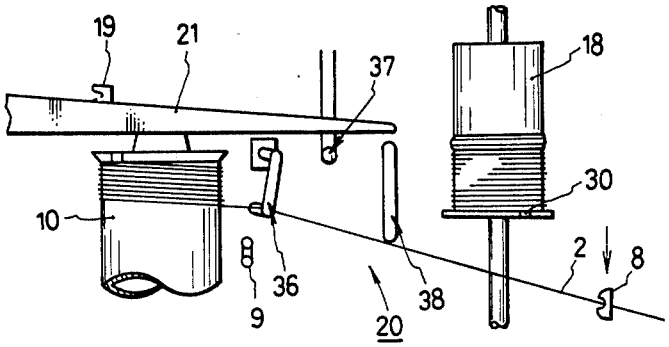
Figure 22:
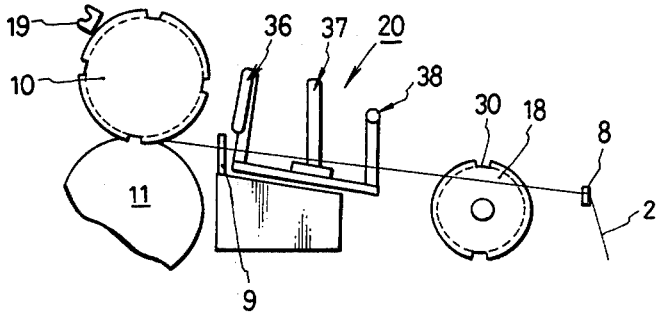

The traverse fulcrum guide 8 is moved toward the front of the bobbin as indicated by an arrow (FIG. 17). At this point, the yarn 2 passes over the auxiliary winding roller 18 while sliding on the head 44 of the third guide 38, but the yarn 2 is prevented from falling in contact with the cutting hook 30 of the auxiliary winding roller 18. After the yarn has completely passed above the cutting hook 30, the yarn falls down from the head 44 of the third guide 38 (FIG. 21). Finally, the yarn is completely released from the restraining actions of the first, second and third guides (FIG. 22).

Eighth Operation

The yarn running between the traverse fulcrum guide 8 on the front of the bobbin 10 and the bobbin 10 is caught automatically with a slit of traveller of the traversing means 9 to impart a traversing movement to the yarn. Thus, normal winding of the yarn on the bobbin 10 is started again.

As will be apparent from the foregoing illustration of the bobbin exchange operation, special arrangement should be made on the configuration, position and height of the yarn-setting thread line-forming guide 20. These special arrangements will now be described in detail by reference to FIGS. 6 and 8.

While the yarn 2 running between the detour guide 19 and the traverse fulcrum guide 8 is being pushed toward the front of the bobbin 10 by the second guide 37 of the yarn-setting thread line-forming guide 20, the first guide 36 has an action of controlling the height of the yarn 2 so that the yarn 2 is caught on the hook 28 of the bobbin supporting arm 21. Accordingly, the height and width of the marginal portion 42 of the first guide 36 should be set so that the above action can be exerted sufficiently.

The second guide 37 exerts mainly a function of pushing the yarn 2 running between the detour guide 19 and the traverse fulcrum guide 8 toward the front of the bobbin 10, and it should have a height sufficient to hold the yarn 2 on the marginal portion 42 of the first guide 36 and the head portion 44 of the third guide 38. The third guide 38 exerts such a function that when the yarn running on a thread line formed between the traverse fulcrum guide 8 and the first guide 36 is pushed by the body portion 43 of the second guide 37 to move the yarn to the front position of the bobbin 10 or when the traverse fulcrum guide 8 is moved from the front position of the auxiliary winding roller 18 to the front position of the bobbin 10, the yarn running between the traverse fulcrum guide 8 and the marginal portion 42 of the first guide 36 is prevented from falling in contact with the hook 30 of the auxiliary winding roller 18 but is allowed to move above said hook 30. Accordingly, the head portion 44 of the third guide 38 should be located at a high position sufficient to exert the above function, and it should have a width sufficient to exert the above function.

Moreover, the foregoing three guides of the yarn-setting thread line-forming guide 20 should have such configurations and should be located at such positions that when the traverse fulcrum guide 8 is stopped at the front position of the bobbin 10 and the yarn which has passed through this guide 8 is wound on the bobbin 10, the three guides are not brought into contact with the running yarn being wound on the bobbin 10.

In order to illustrate that the quantity of waste generated when the yarn is actually wound by using the above-mentioned winding apparatus of the present invention is much reduced as compared with the qunatity of waste produced in the conventional winding method using a suction gun for taking up the running yarn, the following Examples are shown.

EXAMPLE 1

In a winding machine winding a 150-denier polyethylene terephthalate filamentary yarn at a speed of 400 m/min, after the yarn had been wound in an amount of 3.125 Kg on one bobbin, the running yarn was wound for 1 second on an auxiliary winding roller disposed separately from the bobbin and the winding machine was stopped. About 5 seconds were required for complete stopping of the rotation of the winding machine.

Then, about 0.5 m of the filamentary yarn was taken out from the auxiliary winding roller and passed through respective guide elements of a yarn setting guide, and immediately, the winding machine was started again. When the yarn speed was elevated to the above-mentioned level, the yarn was set and hung on an empty bobbin. About 8 seconds were required for completion of the above bobbin exchange operation. The amount of waste produced during this bobbin exchange operation was 1.5 g per spindle.

In contrast, when the bobbin exchange operation was carried out by using a suction gun according to the conventional method without stopping the winding machine, even if an expert having two years' experience performed this operation, 20 seconds were necessary for completion of the operation for one spindle, and the amount of waste produced by this operation was 2.5 g per spindle.

EXAMPLE 2

In a winding machine winding a 150-denier polyethylene terephthalate filamentary yarn at a speed of 400 m/min, the yarn speed was reduced to about 25 m/min for the bobbin exchange operation, and in each unit, the yarn was wound on an auxiliary winding roller after the yarn-passing operation. This procedure was conducted in succession on all the units (196 spindles).

Then, the winding machine was stopped, and the filamentary yarn was taken out from the auxiliary winding roller and passed through respective guide elements of a yarn-setting guide. Immediately, the winding machine was started again and when the yarn speed was elevated to 400 m/min, the yarn was set and hung onto an empty bobbin.

During the foregoing bobbin exchange operation, the time required for the yarn-passing operation at the low speed was 90 seconds per spindle on the average, and this yarn-passing operation in all the spindles was performed by 4 workers. The time required for starting the winding machine again was 8 seconds. The total amount of waste produced was 2.5 Kg.

On the other hand, when the bobbin exchange operation was carried out by using a suction gun, the yarn-passing operation was similarly conducted at a low speed and the yarn was wound on bobbins of the respective spindles, and the yarn speed was immediately elevated at 400 m/min and the yarn was set and hung in succession on empty bobbins. About 20 seconds were necessary for completion of this yarn setting and hunging operation on one empty bobbin, and 32 minutes were necessary for completion of this operation in all the spindles by two workers. The total amount of waste produced was 21.5 Kg.

As will be apparent from the experimental results shown in Example 1, even when the present invention is applied to the bobbin exchange operation on one bobbin, there can be attained an effect of reducing the quantity of waste produced, and as will be apparent from the experimental results shown in Example 2, this waste-reducing effect is prominently increased when the present invention is applied to a multi-spindle winding machine.

What is claimed is:

1. A yarn winding method comprising the steps of (a) shifting a thread line of a yarn running to a full bobbin to the outside of a yarn-traversing width and introducing the yarn to a rotating auxiliary winding roller disposed separately from the full bobbin to wind the yarn on said auxiliary winding roller, (b) stopping travelling of the yarn and rotation of the auxiliary winding roller, (c) taking out the full bobbin from a winder and attaching an empty bobbin to the winder, (d) rotating the auxiliary winding roller in the reverse direction to unwind the yarn therefrom, and forming a yarn-setting thread line adjacent the empty bobbin, (e) starting travelling of the yarn, rotation of the auxiliary winding roller in the normal direction and rotation of the empty bobbin, and (f) shifting the yarn setting thread line within the yarn-traversing width and into engagement with the empty bobbin to start winding of the running yarn onto the empty bobbin.

2. A yarn winding apparatus which comprises (a) a supporting arm on which a bobbin is dismountably and rotatably supported, (b) a rotating and driving element for rotating the bobbin, (c) a traversing element for traversing a running yarn fed to the bobbin over a yarn traversing width, (d) a traverse fulcrum guide for forming a traverse fulcrum for the traversed yarn, (e) a moving element for shifting the traverse fulcrum guide to the outside of said yarn-traversing width, (f) an auxiliary winding roller located at a position where the auxiliary winding roller can catch the yarn conveyed by the traverse fulcrum guide when the traverse fulcrum guide is shifted to the outside of the yarn-traversing width, (g) a rotating means comprising an element for rotating the auxiliary winding roller in the yarn-winding normal direction and an element for rotating the auxiliary winding roller in the reverse direction, (h) a detour guide for forming a thread line for setting to the bobbin the yarn extended from the auxiliary winding roller to the traverse fulcrum guide located outside the yarn-traversing width, by taking out the yarn from the auxiliary winding roller, and (i) a yarn-setting thread line-forming guide means for preventing the yarn on said yarn-setting thread line from falling in contact with the auxiliary winding roller at a point different from the yarn take-up point when it shifts the yarn on said yarn-setting thread line toward and into engagement with the bobbin.

* * * * *